US011268500B2

(12) United States Patent
Yu et al.

(10) Patent No.: US 11,268,500 B2
(45) **Date of Patent: *Mar. 8, 2022**

(54) LINEAR COMPRESSOR WITH A PLURALITY OF SPRING STRANDS

(71) Applicant: LG Electronics Inc., Seoul (KR)

(72) Inventors: Hyosang Yu, Seoul (KR); Sanga Park, Seoul (KR)

(73) Assignee: LG Electronics Inc., Seoul (KR)

( * ) Notice: Subject to any disclaimer, the term of this patent is extended or adjusted under 35 U.S.C. 154(b) by 26 days.

This patent is subject to a terminal disclaimer.

(21) Appl. No.: 16/703,152

(22) Filed: Dec. 4, 2019

(65) Prior Publication Data

US 2020/0182229 A1 Jun. 11, 2020

Related U.S. Application Data

(63) Continuation of application No. 16/514,570, filed on Jul. 17, 2019.

(30) Foreign Application Priority Data

Jul. 17, 2018 (KR) ..... 10-2018-0082696
Aug. 28, 2018 (KR) ..... 10-2018-0101466

(51) Int. Cl.
*F04B 9/02* (2006.01)
*F04B 53/14* (2006.01)
(Continued)

(52) U.S. Cl.
CPC ..... *F04B 9/025* (2013.01); *F04B 35/045* (2013.01); *F04B 53/001* (2013.01); *F04B 53/14* (2013.01)

(58) Field of Classification Search
None
See application file for complete search history.

(56) References Cited

U.S. PATENT DOCUMENTS 3,143,281 A 8/1964 Heinrich
7,153,108 B2 12/2006 Puff et al.
(Continued)

FOREIGN PATENT DOCUMENTS

CN 1503878 6/2004
CN 201137661 10/2008
(Continued)

OTHER PUBLICATIONS

Extended European Search Report in European Application No. 19186707.6, dated Oct. 16, 2019, 10 pages.
(Continued)

*Primary Examiner* — Peter J Bertheaud
*Assistant Examiner* — Geoffrey S Lee
(74) *Attorney, Agent, or Firm* — Fish & Richardson P.C.

(57) ABSTRACT

A linear compressor includes a piston that reciprocates on a spring central axis extending in an axial direction and a spring that axially elastically supports the piston. The spring includes a plurality of spring strands. The spring strands each include a spring body spirally extending along a spring central axis C, a front spring link forming an end of the spring body by extending from a side of the spring body, and a rear spring link forming the other end of the spring body by extending from the other side of the spring body. Of the spring strands, the front spring links are disposed axially in the same plane P1 and the rear spring links are disposed axially in the same plane P2.

17 Claims, 12 Drawing Sheets

(51) Int. Cl.
*F04B 53/00* (2006.01)
*F04B 35/04* (2006.01)

(56) References Cited

U.S. PATENT DOCUMENTS

| | | | | |
|---|---|---|---|---|
| 7,247,007 | B2 | 7/2007 | Roke et al. | |
| 2004/0141860 | A1* | 7/2004 | Puff | F04B 35/045 417/417 |

FOREIGN PATENT DOCUMENTS

| | | |
|---|---|---|
| EP | 2960503 | 12/2015 |
| JP | 2003512581 | 4/2003 |
| KR | 1020050017236 | 2/2005 |
| KR | 1020050060932 | 6/2005 |
| KR | 20060026194 | 3/2006 |
| KR | 20060039178 | 5/2006 |
| KR | 20100092501 | 8/2010 |
| KR | 20180053859 | 5/2018 |
| WO | WO2011082461 | 7/2011 |

OTHER PUBLICATIONS

Chinese Office Action in Chinese Appln. No. 201910645318.8, dated Dec. 9, 2020, 12 pages (with English translation).

* cited by examiner

LINEAR COMPRESSOR WITH A PLURALITY OF SPRING STRANDS

CROSS REFERENCE TO RELATED APPLICATION

The present application is a continuation of U.S. application Ser. No. 16/514,570, filed on Jul. 17, 2019, which claims priority to Korean Patent Application No. 10-2018-0082696, filed on Jul. 17, 2018 and No. 10-2018-0101466, filed on Aug. 28, 2018. The disclosures of the prior applications are incorporated by reference in their entirety.

FIELD

The present disclosure relates to a linear compressor.

BACKGROUND

In general, a compressor, which is a mechanical apparatus that increases the pressure of air, a refrigerant, or other various working gases by compressing them using power from a power generator such as an electric motor or a turbine, is generally used for appliances or throughout industry.

Compressors can be classified in a broad sense into a reciprocating compressor, a rotary compressor, and a scroll compressor.

As for the reciprocating compressor, a compression space into or from which a working gas is suctioned or discharged is formed between a piston and a cylinder and the piston compresses the refrigerant by reciprocating straight in the cylinder.

As for the rotary compressor, a compression space into or from which a working gas is suctioned or discharged is formed between a roller that eccentrically rotates and a cylinder and the roller compresses the working gas by eccentrically rotating on the inner side of the cylinder.

As for the scroll compressor, a compression space into or from which a working gas is suctioned or discharged is formed between an orbiting scroll and a fixed scroll and the orbiting scroll compresses a refrigerant by rotating on the fixed scroll.

Recently, a linear compressor that can improve compression efficiency with a simple structure without a mechanical loss due to conversion of motions by having a piston directly connected to a driving motor that generates a straight reciprocating motion has been developed as one of the reciprocating compressors.

The linear compressor suctions, compresses, and then discharges a refrigerant by reciprocating straight the piston in a cylinder using a linear motor in a sealed shell.

Further, the linear compressor may include a resonant spring for stably moving an actuator including the piston. The resonant spring is understood as a component that reduces vibration and noise due to movement of the actuator.

The applicant(s) has filed the following Prior Art Document 1 in connection with a linear compressor with a resonant spring structure.

PRIOR ART DOCUMENT 1

1. Publication No.: 10-2018-0053859 (Publication Date: May 24, 2018)

2. Title of Invention: Linear compressor

A plurality of resonant springs is disposed behind a piston in the linear compressor of Prior Art Document 1. The resonant springs include a first resonant spring disposed between a supporter that supports the piston and a stator cover that supports an outer stator and a second resonant spring disposed between the supporter and a rear cover.

The linear compressor of Prior Art Document has the following problems.

The central axis of the actuator that reciprocates and the central axes of the first resonant spring and the second resonant spring do not coincide. Accordingly, when the actuator reciprocates, lateral force is generated on the first and second resonant springs. There is a problem that larger external force is applied to the springs due to the lateral force, whereby a problem such as distortion occurs.

(2) Further, there is a problem that the resonant springs are small in sizes, so they cannot resist large load or repetitive load. Accordingly, there is problem that the reciprocation speed of the actuator is limited.

(3) Further, since a plurality of resonant springs is provided, they cannot be freely installed in the shell and the configuration is complicated. Further, the size of the shell is increased due to the installation space for the resonant springs, thereby the compressor cannot be made compact.

SUMMARY

The present invention has been made in an effort to solve the problems and an object of the present invention is to provide a linear compressor in which lateral force that is generated on a spring is reduced by making the central axis of the spring and the central axis of a driving assembly that reciprocate coincide with each other.

Another object of the present invention is to provide a linear compressor in which a driving assembly can be operated at a high speed by supporting the load of the driving assembly or repetitive load with a spring composed of a plurality of spring strands.

Another object of the present invention is to provide a linear compressor including small and compact shell because one spring composed of a plurality of spring strands is disposed in the shell.

The linear compressor according to an aspect of the present invention includes a piston that reciprocates on a spring central axis extending in an axial direction and a spring that axially elastically supports the piston. The spring includes a plurality of spring strands.

The spring strands each include a spring body spirally extending along a spring central axis C, a front spring link forming an end of the spring body by extending from a side of the spring body, and a rear spring link forming the other end of the spring body by extending from the other side of the spring body.

Of the spring strands, the front spring links are disposed axially in the same plane P1 and the rear spring links are disposed axially in the same plane P2.

The spring strands may be the same in shape and size. In detail, the spring bodies axially extend while each forming a virtual circle having a spring diameter R in a radial direction. The spring strands have the same axial spring height H.

According to the linear compressor of an embodiment of the present invention having the configuration described above, there are the following effects.

Since the central axis of the driving assembly that reciprocates and the central axis of the spring coincide, lateral force that is applied to the spring can be removed.

Accordingly, the spring can resist larger load or repetitive load and the driving assembly can be moved at a high speed.

Further, since the driving assembly is moved at a high speed, compression efficiency is increased and the performance of the linear compressor is improved.

Further, since the driving assembly is supported by one spring, the inside of the shell in which the spring is installed can be simplified. Further, it is possible to reduce the size of the shell, where by the size of the linear compressor is decreased. Further, a space where the compressor is installed can be reduced, so the compressor can be more freely installed.

Further, the spring can be formed in various shapes. Accordingly, it is possible to effectively support the driving assembly by forming the spring in various shapes, if necessary.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION

Figure 1:
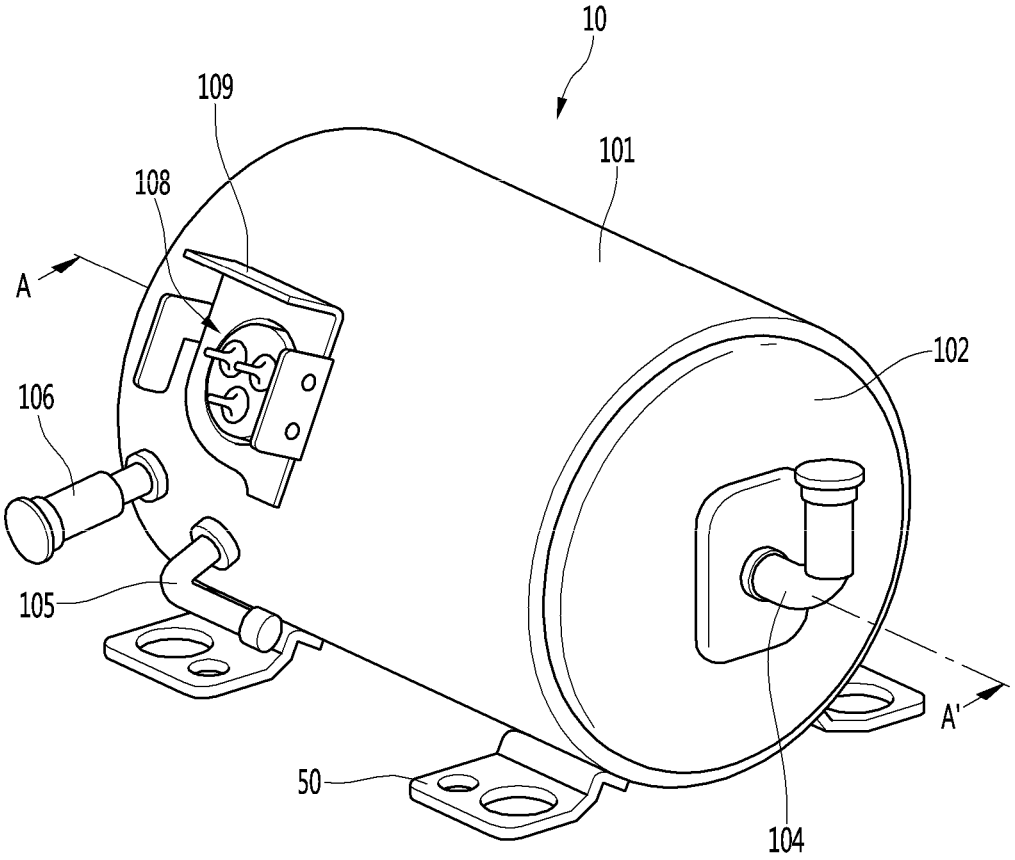
FIG. 1 is a view showing a linear compressor according to an embodiment of the present invention.

Hereinafter, embodiments of the present invention are described in detail with reference to exemplary drawings. When components are given reference numerals in the drawings, the same components are given the same reference numerals even if they are shown in different drawings. Further, in the following description of embodiments of the present invention, when detailed description of well-known configurations or functions is determined as interfering with understanding of the embodiments of the present invention, they are not described in detail.

Further, terms 'first', 'second', 'A', 'B', '(a)', and '(b)' can be used in the following description of the components of embodiments of the present invention. The terms are provided only for discriminating components from other components and, the essence, sequence, or order of the components are not limited by the terms. When a component is described as being "connected", "combined", or "coupled" with another component, it should be understood that the component may be connected or coupled to another component directly or with another component interposing therebetween.

FIG. 1 is a view showing a linear compressor according to an embodiment of the present invention.

As shown in FIG. 1, a linear compressor 10 according to an embodiment of the present invention includes a shell 101 and shell covers 102 and 103 (see FIG. 3) combined with the shell 101. In a broad sense, the shell covers 102 and 103 may be understood as components of the shell 101.

Legs 50 may be coupled to the bottom of the shell 101. The legs 50 may be coupled to the base of a product on which the linear compressor 10 is installed. For example, the product may include a refrigerator and the base may include the mechanical chamber base of the refrigerator. Alternatively, the product may include the outdoor unit of an air-conditioning system and the base may include the base of the outdoor unit.

The shell 101 may have a substantially cylindrical shape and may be laid down laterally or axially. On the basis of FIG. 1, the shell 101 may be laterally elongated and may have a relatively small radial height. That is, the linear compressor 10 may be small in height, so when the linear compressor 10 is disposed on the base of the mechanical chamber of a refrigerator, the height of the mechanical chamber can be reduced.

Further, the shell 101 of the linear compressor 10 according to an aspect of the present invention may have a relatively small lateral length. In this case, the length means an axial length. This is because a supporting structure of a driving assembly to be described below is simplified. Accordingly, the shell 101 has a relatively small volume, so a space for installing the linear compressor 10 can be considerably reduced.

A terminal 108 may be disposed on the outer side of the shell 101. The terminal 108 is understood as a component that transmits external power to a motor assembly 140 (see FIG. 3) of the linear compressor. The terminal 108 can be connected to a lead wire of a coil 141*c* (see FIG. 3).

A bracket 109 is disposed outside the terminal 108. The bracket 109 may include a plurality of brackets disposed around the terminal 108. The bracket 109 may perform a function of protecting the terminal 108 from external shock.

Both sides of the shell 101 are open. The shell covers 102 and 103 can be coupled to both open sides of the shell 101. In detail, the shell covers 102 and 103 include a first shell cover 102 coupled to one open side of the shell 101 and a second shell cover 103 coupled to the other open side of the shell 101. The internal space of the shell 101 can be sealed by the shell covers 102 and 103.

In FIG. 1, the first shell cover 102 may be positioned at the right side of the linear compressor 10 and the second shell cover 103 may be positioned at the left side of the linear compressor 10. That is, the first and second shell covers 102 and 103 may be arranged opposite each other.

The linear compressor 10 further includes a plurality of pipes 104, 105, and 106 disposed at the shell 101 or the shell covers 102 and 103 to suction, discharge, or inject a refrigerant. The pipes 104, 105, and 106 include a suction pipe 104, a discharge pipe 105, and a process pipe 106.

The suction pipe 104 is provided to suction a refrigerant into the linear compressor 10. For example, the suction pipe 104 may be coupled to the first shell cover 102. A refrigerant can be suctioned into the linear compressor 10 axially through the suction pipe 104.

Figure 3:
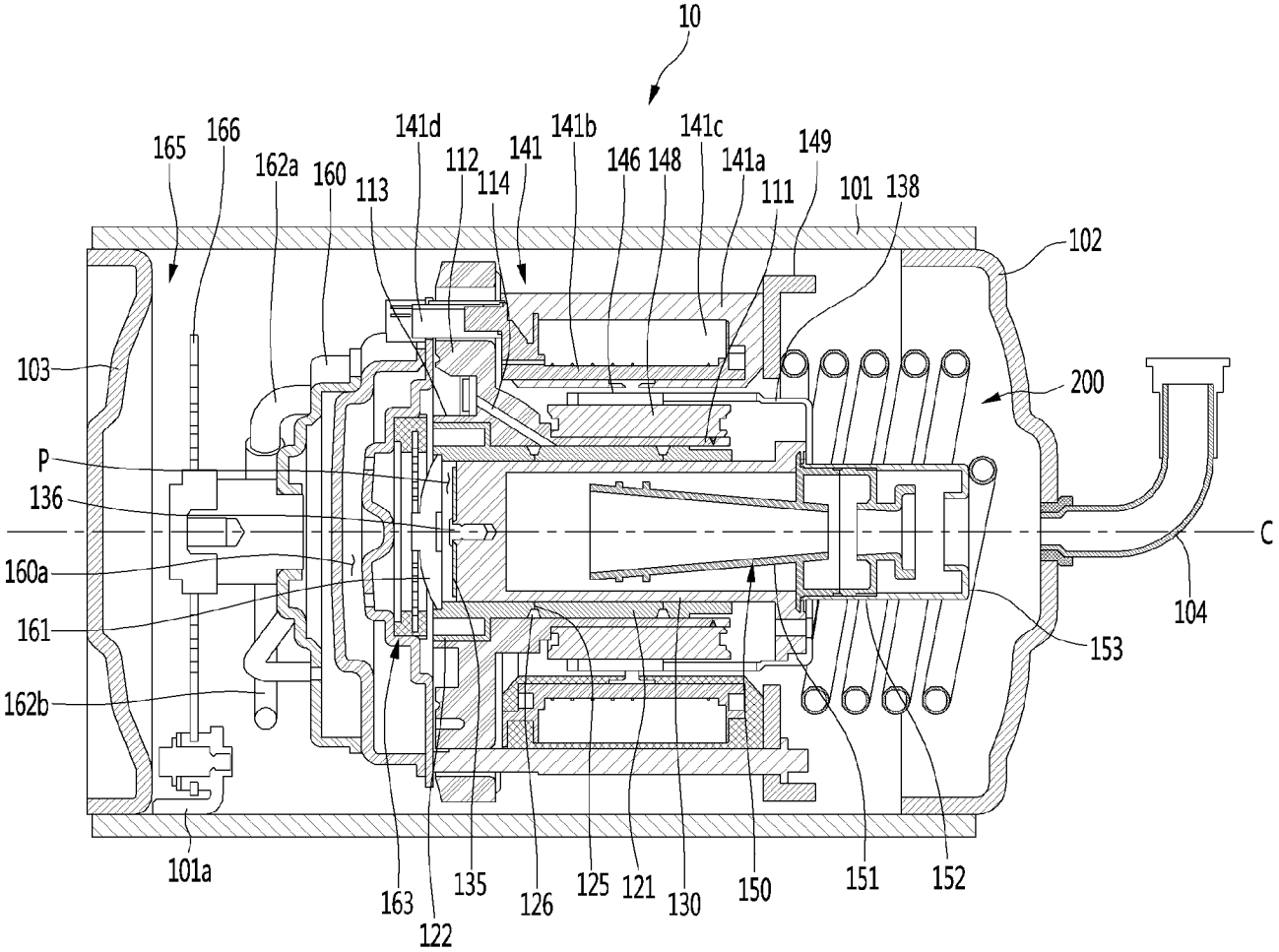
FIG. 3 is a cross-sectional view taken along line A'-A' of FIG. 1.

Referring to FIG. 3, it can be seen that the suction pipe 104 is axially disposed on the shell 101. In detail, the suction pipe 104 is disposed on the shell 101 to coincide with the central axis of the piston 130 to be described below. Further, the suction pipe 104 can be understood as being disposed on the shell 101 on a spring central axis C to be described below.

The suction pipe 104 disposed on the outer side of the shell 101 may be bent to a side. That is, the suction pipe 104 axially extends at the portion coupled to the shell 101. This is for allowing a refrigerant to axially flow into the shell 101. That is, a refrigerant axially flowing inside through the suction pipe 104 can flow to the piston 130 without changing the flow direction and can be compressed. Accordingly, it is possible to prevent reduction of flow speed and a flow loss of the suctioned refrigerant.

The discharge pipe 105 is provided to discharge a compressed refrigerant out of the linear compressor 10. The discharge pipe 105 may be coupled to the outer side of the shell 101. The refrigerant suctioned through the suction pipe 104 can be compressed while axially flowing. The compressed refrigerant can be discharged through the discharge pipe 105. The discharge pipe 105 may be positioned closer to the second shell cover 103 than the first shell cover 102.

The process pipe 106 is provided to replenish the linear compressor 10 with a refrigerant. The process pipe 106 may be coupled to the outer side of the shell 101. A worker can inject a refrigerant into the linear compressor 10 through the process pipe 106.

The processor pipe 106 may be coupled to the shell 101 at a different height from the discharge pipe 105 to avoid interference with the discharge pipe 105. The height is understood as the vertical (or radial) distance from the legs 50. Since the discharge pipe 105 and the process pipe 105 are coupled at different heights to the outer side of the shell 101, a worker can conveniently work.

At least a portion of the second shell cover 103 may be positioned on the inner side of the shell 101, close to the position where the process pipe 106 is coupled. That is, at least a portion of the second shell cover 103 can act as resistance against the refrigerant that is injected through the process pipe 106.

Accordingly, in terms of a channel for a refrigerant, a channel for a refrigerant that flows inside through the process pipe 106 is formed such that the size decreases toward the inside of the shell 101. In this process, the pressure of the refrigerant is reduced, so the refrigerant may vaporize.

Further, in this process, oil contained in the refrigerant may be removed. Accordingly, a gas refrigerant with oil removed flows into a piston 130, so the performance of compressing a refrigerant can be improved. The oil may be understood as a working oil existing in a cooling system.

Figure 2:
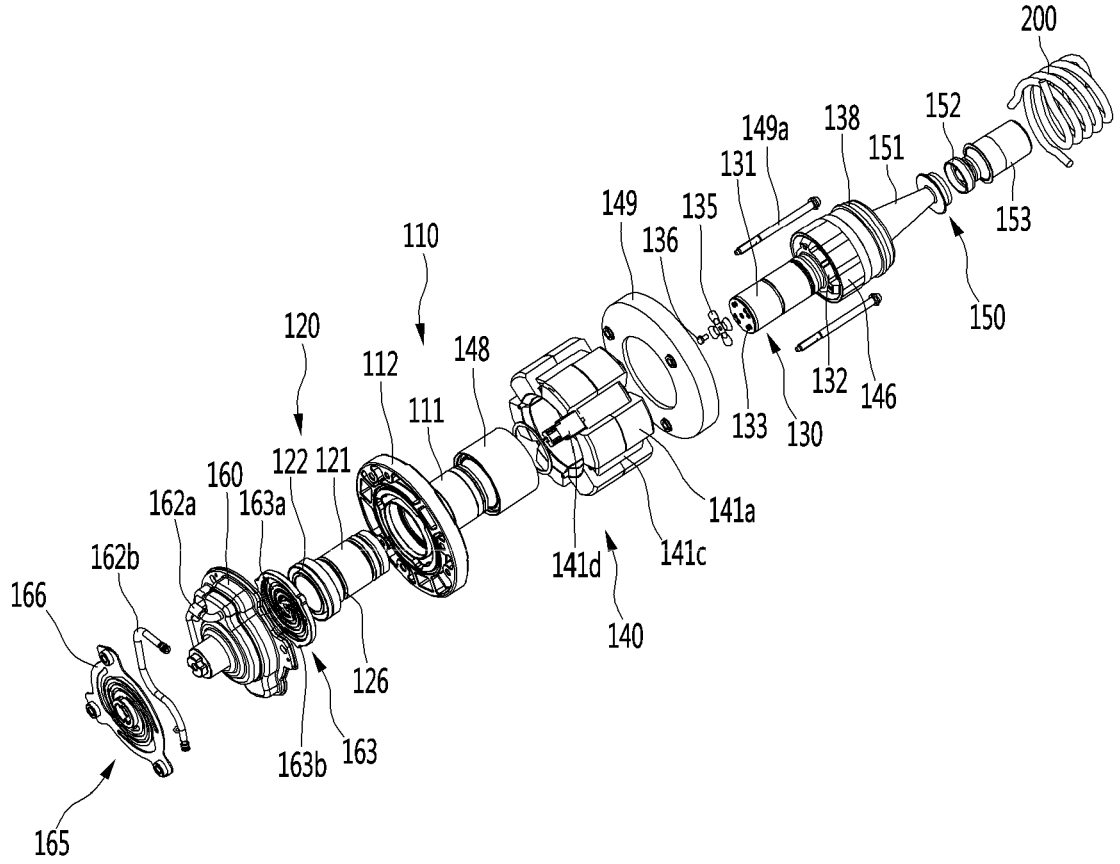
FIG. 2 is an exploded view showing the components in the linear compressor according to an embodiment of the present invention.
Figure 4:
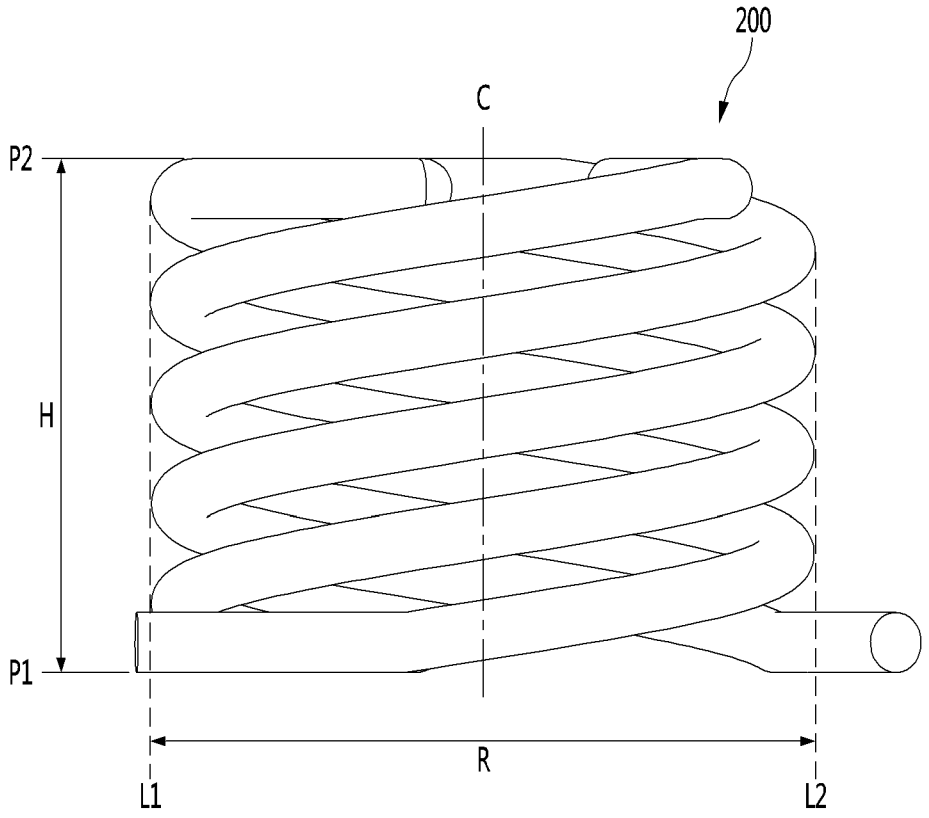
FIG. 4 is a view showing a spring of the linear compressor according to an embodiment of the present invention.

FIG. 2 is an exploded view showing the components in the linear compressor according to an embodiment of the present invention and FIG. 3 is a cross-sectional view taken along line A-A' of FIG. 4. The shell 101 and the shell covers 102 and 103 are not shown in FIG. 2 for the convenience of description.

As shown in FIGS. 2 and 3, the linear compressor 10 according to an aspect of the present invention includes a frame 110, a cylinder 120, a piston 130, and a motor assembly 140. The motor assembly 140 is a linear motor that provides a driving force to the piston 130 and the piston 130 can be reciprocated by operation of the motor assembly 140.

Directions are defined as follows.

The term "axial direction" may be understood as the reciprocation direction of the piston 130, that is, the transverse direction in FIG. 3. In the "axial direction", the direction going toward the compression space P from the suction pipe 104, that is, the flow direction of a refrigerant is defined as a "forward direction" and the opposite direction is defined as a "rear direction" When the piston 130 is moved forward, the compression space P can be compressed.

Meanwhile, the term "radial direction", which is the direction perpendicular to the reciprocation direction of the piston 130, may be understood as the vertical direction in FIG. 3. In the "radial direction", the direction going toward the shell 101 from the center axis of the piston 130 is defined as a radial "outward direction" and the opposite direction is defined as a radial "inward direction".

The cylinder 120 is disposed inside the frame 110. The frame 110 is understood as a component for fixing the cylinder 120. For example, the cylinder 120 may be forcibly fitted in the frame 110.

The frame 110 includes a frame body 111 axially extending and a frame flange 112 extending radially outward from the frame body 111. The frame body 111 and the frame flange 112 may be integrated.

The frame body 111 is formed in a cylindrical shape with open axial top and bottom. The cylinder 120 is disposed radially inside the frame body 111. The frame flange 112 is formed in a disc shape having a predetermined axial thickness. In particular, the frame flange 112 radially extends from the front end of the frame body 111.

A gas hole 113 recessed rearward from the front surface of the frame flange 112 is formed on the frame flange 112. A gas channel 114 extending through the frame flange 112 and the frame body 111 from the gas hole 113 is formed in the frame 110.

The piston 130 is movably disposed in the cylinder 120. The cylinder 120 includes a cylinder body 121 axially extending and a cylinder flange 122 formed on the outer side of the front portion of the cylinder body 121.

The cylinder body 121 is formed in a cylindrical shape having an axial center axis and is inserted in the frame body 111. Accordingly, the outer side of the cylinder body 121 may be positioned to face the inner side of the frame body 111.

The cylinder flange 122 extends radially outward and extends forward from the front portion of the cylinder body 121. When the cylinder 120 is inserted into the frame 110, the cylinder flange 122 is deformed, so the cylinder 120 can be forcibly fitted.

A gas inlet 126 is recessed radially inward on the outer side of the cylinder body 121. The gas inlet 126 may be circumferentially formed around the outer side of the cylinder body 121 about the central axis. A plurality of gas inlets 126 may be provided. For example, two gas inlets 126 may be provided.

The cylinder body 121 includes a cylinder nozzle 125 extending radially inward from the gas inlet 126. The cylinder nozzle 125 may extend to the inner side of the cylinder body 121. That is, the cylinder nozzle 125 extends to the outside around the piston 130.

By this structure, a refrigerant that function as a gas bearing can be supplied to the piston 130. In detail, at least some of a refrigerant flows inside through the gas hole 113. Further, the refrigerant is supplied to the outside around the cylinder 120 along the gas channel 114. Further, the refrigerant can be supplied to the piston 130 through the gas inlet 126 and the cylinder nozzle 125.

Further, the linear compressor 10 according to an aspect of the present invention can also be driven by an oil bearing.

The piston 130 includes a substantially cylindrical piston body 131 and a piston flange 132 radially extending from the piston body 131. The piston body 131 can reciprocate in the cylinder 120 and the piston flange 132 can reciprocate outside the cylinder 120.

The linear compressor 10 further includes a suction muffler 150 disposed in the piston 130. The suction muffler 150 is a component for reducing noise that is generated by a refrigerant suctioned through the suction pipe 104. In detail, the refrigerant suctioned through the suction pipe 104 flows into the piston 130 through the suction muffler 150. The flow noise of the refrigerant can be reduced while the refrigerant flows through the suction muffler 150.

The suction muffler 150 includes a plurality of mufflers 151, 152, and 153. The mufflers 151, 152, and 153 include a first muffler 151, a second muffler 152, and a third muffler 153 that are assembled together. The refrigerant suctioned through the suction pipe 104 can sequentially flow through the third muffler 153, the second muffler 152, and the first muffler 151.

In detail, the first muffler 151 is disposed in the piston 130 and the second muffler 152 is coupled to the rear end of the first muffler 151. The third muffler 153 receives the second muffler 152 and may extend rearward from the first muffler 151.

As shown in FIGS. 2 and 3, the first muffler 151 may be formed such that the area increases in the flow direction of a refrigerant. That is, the first muffler 151 has a tapered portion in which a flow cross-sectional area gradually increases in the flow direction of a refrigerant.

By this structure, the cross-sectional area through which a refrigerant flows gradually increases, the flow speed of the refrigerant gradually decreases, and the pressure of the refrigerant increases. Further, the pressure of the refrigerant can further increases, a suction valve 135 to be described below can be more quickly bent, and a larger amount of refrigerant can flow to the compression space P.

The compression space P, which is a space where a refrigerant is compressed by the piston 130, is defined in the cylinder 120 and ahead of the piston 130.

Suction holes 133 allowing a refrigerant to flow into the compression space P are formed at the front of the piston 130 and a suction valve 135 for selectively opening the suction holes 133 is disposed ahead of the suction holes 133. The suction valve 135 can be coupled to the piston 130 by a fastener 136.

A discharge cover 160 defining a discharge space 160*a* for the refrigerant discharged from the compression space P and a discharge valve assembly 161 and 163 coupled to the discharge cover 160 to selectively discharge the refrigerant compressed in the compression space P are disposed ahead of the compression space P. The discharge space 160*a* includes a plurality of sections divided by the inner side of the discharge cover 160. The sections are arranged in the front-rear direction and can communicate with one another.

The discharge valve assembly 161 and 163 includes a discharge valve 161 that allows a refrigerant to flow into the discharge space of the discharge cover 160 by opening when the pressure in the compression space P becomes a discharge pressure or more and a spring assembly 163 that is disposed between the discharge valve 161 and the discharge cover 160 and axially provides elasticity.

The spring assembly 163 includes a valve spring 163*a* and a spring supporting assembly 163*b* for supporting the valve spring 163*a* on the discharge cover 160. For example, the valve spring 163*a* may include a plate spring. The spring supporting assembly 163*b* may be integrally formed with the valve spring 163*a* by injection molding.

The discharge valve 161 is coupled to the valve spring 163*a* and the rear portion or the rear surface of the discharge valve 161 is disposed to be able to be supported on the front surface of the cylinder 120. When the discharge valve 161 is supported on the front surface of the cylinder 120, the compression space P is maintained in a sealed state, and when the discharge valve 161 is spaced from the front surface of the cylinder 120, the compression space P is opened and the compressed refrigerant in the compression space P can be discharged.

The linear compressor 10 further includes a retainer 165 coupled to the discharge cover 160 and supporting a side of the body of the compressor 10. The retainer 165 is disposed close to the second shell 103 and can elastically support the body of the compressor 10.

In detail, the retainer 165 includes a supporting spring 166. A spring holder 101*a* may be disposed on the inner side of the shell 101, close to the second shell cover 103. The supporting spring 166 may be coupled to the spring holder 101*a*. Since the spring holder 101*a* and the retainer 165 are coupled to each other, the body of the compressor can be stably supported in the shell 101.

The compression space P can be understood as a space defined between the suction valve 135 and the discharge valve 161. The suction valve 135 may be formed at a side of the compression space P and the discharge valve 161 may be disposed at the other side of the compression space P, that is, opposite the suction valve 135.

When the pressure in the compression space P decreases to a suction pressure or less and lower than a discharge pressure while the piston 130 reciprocates in the cylinder 120, the suction valve 135 is opened and a refrigerant is suctioned into the compression space P. However, when the pressure in the compression space P increases to the suction pressure or more, the refrigerant in the compression space P is compressed with the suction valve 135 closed.

When the pressure in the compression space P increases to the discharge pressure or more, the valve spring 163*a* opens the discharge valve 161 by deforming forward and a refrigerant is discharged from the compression space P into the discharge space 160 of the discharge cover 160. When the refrigerant finishes being discharged, the valve spring 163*a* provides a restoring force to the discharge valve 161, so the discharge valve 161 is closed.

The linear compressor 10 further includes a cover pipe 162*a* coupled to the discharge cover 160 to discharge the refrigerant flowing through the discharge space 160*a* of the discharge cover 160. For example, the cover pipe 162*a* may be made of metal.

The linear compressor 10 further includes a loop pipe 162*b* coupled to the cover pipe 162*a* to transmit the refrigerant flowing through the cover pipe 162*a* to the discharge pipe 105. The loop pipe 612*b* may be coupled to the cover pipe 162*a* at a side and to the discharge pipe 105 at the other side.

The loop pipe 162*b* is made of a flexible material and may have a relatively large length. The loop pipe 162*b* may be rounded along the inner side of the shell 101 from the cover pipe 162*a* and coupled to the discharge pipe 105. For example, the loop pipe 162*b* may be wound.

The motor assembly 140 includes an outer stator 141 fixed to the frame 110 around the cylinder 120, an inner stator 148 spaced apart inward from the outer stator 141, and a permanent magnet 146 disposed in the space between the outer stator 141 and the inner stator 148.

The permanent magnet 146 can be reciprocated straight by a mutual electromagnetic force with the outer stator 141 and the inner stator 148. The permanent magnet 146 may be a single magnet having one pole or may be formed by combining a plurality of magnets having three poles.

The permanent magnet 146 may be disposed on a magnet frame 138. The magnet frame 138 may have a substantially cylindrical shape and may be inserted in the space between the outer stator 141 and the inner stator 148.

In detail, on the basis of the cross-sectional view of FIG. 3, the magnet frame 138 may extend radially outward from the rear side of the piston 130 and may bend forward. The permanent magnet 146 may be disposed at the rear portion of the magnet frame 138. When the permanent magnet 146 reciprocates, the piston 130 can axially reciprocate with the permanent magnet 146.

The outer stator 141 includes a coil assembly 141*b*, 141*c*, and 141*d* and a stator core 141*a*. The coil assembly 141*b*, 141*c*, and 141*d* includes a bobbin 141*b* and a coil 141*c* circumferentially wound around the bobbin.

The coil assembly 141*b*, 141*c*, and 141*d* further includes a terminal 141*d* leading or exposing a power line connected to the coil 141*c* to the outside of the outer stator 141. The terminal 141*d* can be led or exposed to the outside through the front from the rear of the frame 110 through the frame flange 112.

The stator core 141*a* includes a plurality of core blocks formed by circumferentially stacking a plurality of laminations. The core blocks may be arranged around at least a portion of the coil assembly 141*b* and 141*c*.

A stator cover 149 is disposed at a side of the outer stator 141. In the outer stator 141, a side may be supported by the frame 110 and the other side may be supported by the stator cover 149.

The linear compressor 10 further includes cover fasteners 149*a* for fastening the stator cover 149 and the frame 110. The cover fasteners 149*a* may extend forward toward the frame 110 through the stator cover 149 and may be coupled to the frame 110.

The inner stator 148 is fixed to the outer side of the frame 110. The inner stator 148 is formed by stacking a plurality of laminations circumferentially outside the frame 110.

That is, the inner stator 148 is coupled to the radial outer side of the frame body 111. The inner stator 148 disposed on the radial outer side of the frame body 111, the permanent magnet 146, and the outer stator 141 are disposed axially behind the frame flange 112.

The configuration of the linear compressor 10 may correspond to one of a reciprocating configuration (hereafter, a driving assembly) and a configuration (hereafter, referred to as a supporting assembly) supporting the driving assembly. For example, the driving assembly includes the piston 130, the permanent magnet 146, the magnet frame 138, and the suction muffler 150.

The supporting assembly includes the frame 110, the stator cover 149 etc. In particular, the supporting assembly can be understood as a configuration that is not the driving assembly. This classification is based on the above description and they may be discriminated in different ways when other configurations are added to or removed from the linear compressor 10.

The linear compressor 10 according to an aspect of the present invention includes a spring 200. The spring 200 can be understood as a resonant spring for stable reciprocation of the driving assembly. In particular, the spring 200 can reduce vibration or noise due to movement of the driving assembly.

Accordingly, the spring 200 can be axially stretched and compressed. For example, the spring 200 may have the shape of a coil spring that is axially stretched or compressed.

Referring to FIG. 3, the spring 200 is disposed close to the first shell cover 102. In particular, the spring 200 may be disposed behind the piston 130. That is, the spring 200 can be understood as a structure that supports the driving assembly D axially behind it. A separate retainer may be further provided between the spring 200 and the first shell cover 102.

Further, the spring 200 connects the driving assembly and the supporting assembly. In particular, an end of the spring 200 can be fixed with the driving assembly and the other end of the spring 200 can be fixed with the supporting assembly. Accordingly, the spring 200 is disposed with both ends fixed. Therefore, in the linear compressor 10 according to an aspect of the present invention, both of tensile force and compressive force of the spring 200 can be used.

Referring to FIG. 3, an end of the spring 200 is fixed to the stator cover 149 and the other end of the spring 200 is fixed to the suction muffler 150. For example, the spring 200 can be fixed to the stator cover 149 and the suction muffler 150 by welding.

However, this coupling is just an example. In short, the spring 200 can connect at least one component of the driving assembly and at least one component of the supporting assembly. In particular, any one of both ends of the spring 200 is fixed to the driving assembly and the other one is fixed to the supporting assembly.

The operation of the compressor 10 according to this coupling structure is briefly described. When the compressor 10 is operated, the driving assembly reciprocates. Accordingly, the end of the spring 200 fixed to the driving assembly also reciprocates. The end of the spring 200 fixed to the supporting assembly is fixed at a predetermined position in this process.

Accordingly, when the driving assembly moves forward, both ends of the spring 200 move away from each other, whereby the spring 200 is stretched. On the other hand, when the driving assembly moves rearward, both ends of the spring 200 move close to each other, whereby the spring 200 is compressed. As the spring 200 is stretched or compressed, as described above, the driving assembly can be elastically supported.

The shape of the spring 200 is described in detail hereafter.

FIG. 4 is a view showing a spring of the linear compressor according to an embodiment of the present invention. In FIG. 4, the vertical direction is an axial direction and the horizontal direction is a radial direction.

As shown in FIG. 4, the spring 200 is a coil spring that is axially stretched and compressed. That is, the spring 200 axially elastically supports the driving assembly including the piston 130. In detail, the spring 200 axially spirally extends.

The spring 200 has a spring height H that is an axial length. The spring height H can be defined as a vertical length between a first plate P1 and a second plane P2. The first plane P1 and the second plane P2 are planes radially extending perpendicular to the axial direction. In particular, the first plane P1 and the second plane 2 are axially spaced apart from each other and the first plane P1 is positioned axially ahead of the second plane P2.

The first plane P1 is a plane where the axial front end of the spring 200 is positioned. The second plane P1 is a plane where the axial rear end of the spring 200 is positioned.

For example, referring to FIG. 3, the first plane P1 may be the rear surface of the stator cover 149. The second plane P2 may be the rear end of the suction muffler 150.

The spring height H is a length that is changed by tension and compression. For example, when the driving assembly is moved forward, the suction muffler 150 is also moved forward. Accordingly, the second plane P2 comes closer to the first plane P1 and the spring height H decreases.

For example, when the driving assembly is moved rearward, the suction muffler 150 is also moved rearward. Accordingly, the second plane P2 goes away from the first plane P1 and the spring height H increases.

The first plane P1 may correspond to a portion of another supporting assembly and the second plane P2 may correspond to a portion of another driving assembly. The first plane P1 may correspond to a portion of a driving assembly and the second plane P2 may correspond to a portion of a supporting assembly.

AS described above, the spring 200 axially spirally extends. Accordingly, the spring 200 can form a virtual circle having a spring diameter R. The spring diameter R is determined in consideration of only at least a portion of the spirally extending spring 200.

As shown in FIG. 4, the spring diameter R can be determined as a line extending the radial outer side of the spring 200. In the figure, the left line is referred to as a first extension line L1 and the right line is referred to as a second extension line L2. The first extension line L1 and the second extension line L2 can be understood as being circumferentially spaced apart from each other by the maximum distance (180 degrees).

For example, when the spring 200 axially extends with the same spring diameter R, the first extension line L1 and the second extension line L2 axially extend. Accordingly, the first extension line L1 and the second extension line L2 are parallel with each other and the spring diameter R corresponds to a vertical length of the first extension line L1 and the second extension line L2.

The center of the spring diameter R is referred to as a spring center and a line axially extending from the spring center is referred to as a spring central axis C. The central axis of the linear compressor 10 according to an aspect of the present invention and the spring central axis C coincide.

The central axis of the compressor 10 can be understood as the central axis of the configuration of the compressor 10. For example, the central axis may be central axes of the cylindrical shell 101, the frame body 111, the cylinder body 121, and the piston body 131. Eccentricity due to operation and design errors are not considered in this case. The central axis of the suction pipe 104 may be included in the central axis of the compressor 10. The central axis of the suction pipe 104 may be a portion of the suction pipe 104 coupled to the shell 101.

In particular, the spring central axis C coincides with the reciprocation central axis of the driving assembly. Accordingly, force except for axial tensile or compressive force can be minimized when the spring 200 supports the driving assembly. That is, lateral force can be minimized, so the spring 200 can effectively support the driving assembly.

Further, as the lateral force is minimized, there is an effect that load on a gas bearing that supports the piston 130 is reduced. Accordingly, it is possible to minimize the amount of a refrigerant that is supplied to the gas bearing and the amount of a refrigerant flowing in the system can be maximized. That is, the efficiency of the linear compressor 10 can be maximized and efficient operation is possible.

Further, it is possible to minimize the channel for supplying a refrigerant to the gas bearing, so it is possible to further secure rigidity of the frame 110 and the cylinder 120.

Referring to FIG. 3, the suction muffler 150 is disposed inside the spring 200. In detail, the spring 200 axially extends around the suction muffler 150. In particular, the spring 200 spirally extends radially outside the third muffler 153.

Accordingly, the spring diameter R is larger than the diameter of the suction muffler 150. Further, the spring diameter R may be larger than the diameter of the piston flange 132 or the magnet frame 138. That is, the spring 200 has a relatively large diameter.

Accordingly, rigidity of the spring 200 is increased and the spring 200 can resist better repetitive load due to reciprocation. As the supporting force of the spring 200 is increased, the driving assembly can be operated at a high speed.

Further, since the spring 200 is disposed around the suction muffler 150, the internal space of the compressor 10 can be effectively used. In particular, the rear cover, etc. of the linear compressors of the related art can be removed, so the axial length of the compressor 10 can be reduced.

Figure 5:
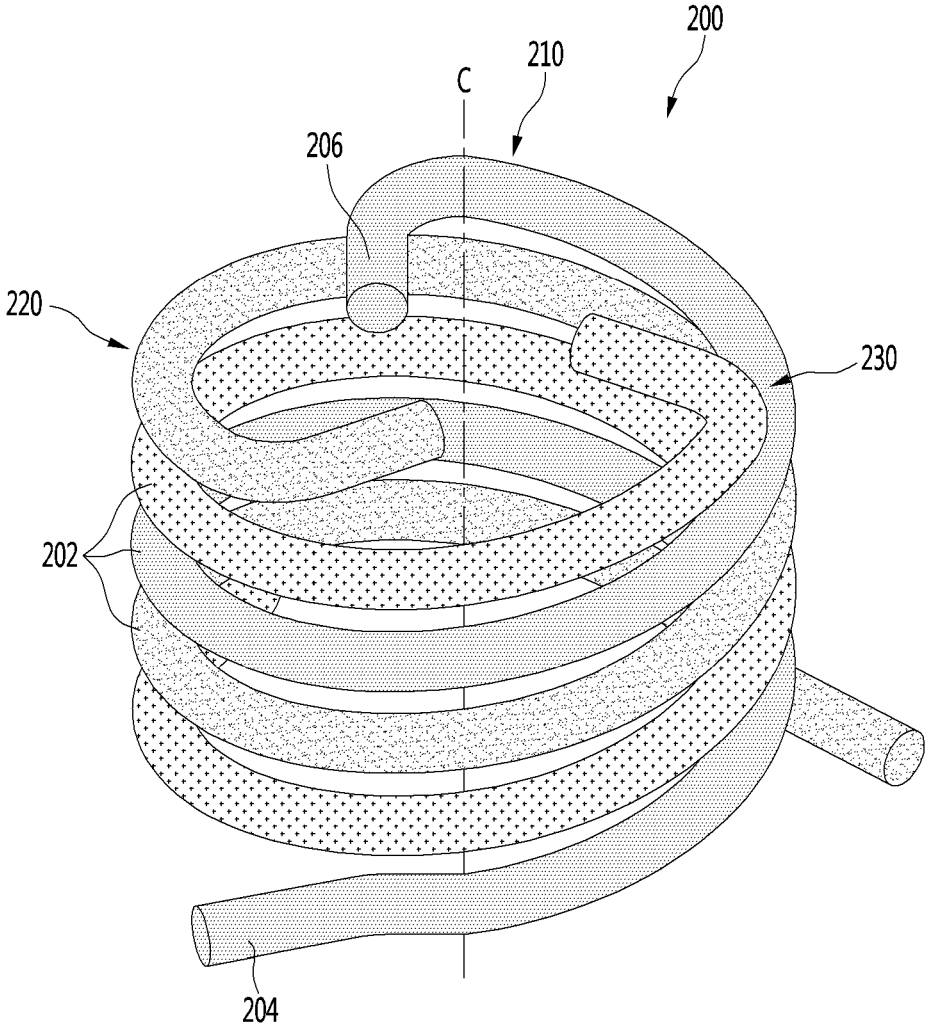
FIGS. 5 and 6 are views discriminately showing springs of a linear compressor according to a first embodiment of the present invention.
Figure 6:
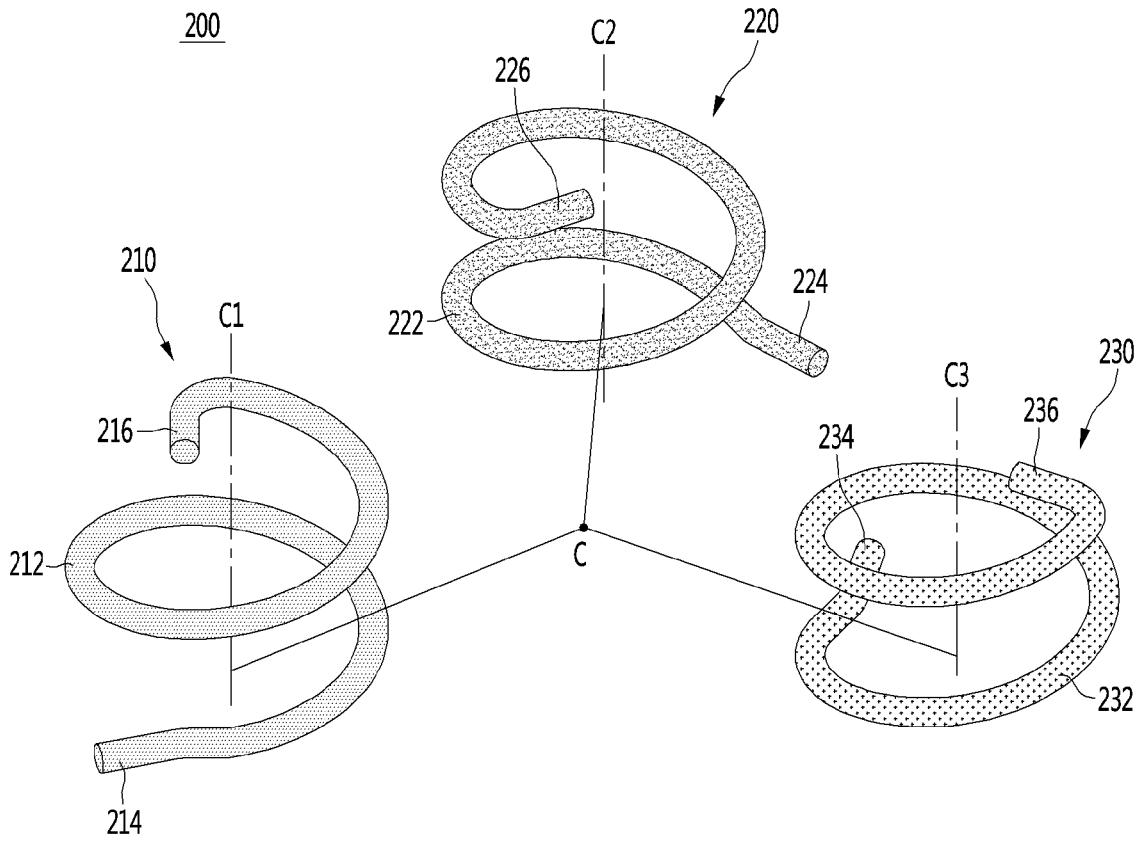

FIGS. 5 and 6 are views discriminately showing springs of a linear compressor according to a first embodiment of the present invention.

As shown in FIGS. 5 and 6, the spring 200 is composed of a plurality of spring strands. In particular, the spring 200 according to the linear compressor 10 according to an aspect of the present invention may be composed of three spring strands 210, 220, and 230.

The term 'spring strands' is used for the convenience of description, but the spring strands 210, 220, and 230 are not a part of a spring, but complete products. In other words, the spring 200 of the present invention can be understood as being formed by combining a plurality of springs.

The spring strands 210, 220, and 230 are the same. In detail, the spring strands 210, 220, and 230 may be the same in shape and size. That is, the spring strands may be made of the same material through the same manufacturing process.

For the convenience of description, the spring strands are respectively referred to as a first spring strand 210, a second spring strand 220, and a third spring strand 230.

Further, for the convenience of understanding, the spring strands 210, 220, and 230 are discriminated in FIGS. 5 and 6. In FIG. 5, one spring 200 has been formed by combining the spring strands 210, 220, and 230. In FIG. 6, the spring strands 210, 220, and 230 have been separated. Although the spring strands 210, 220, and 230 are shown in different shapes due to a limit of a plane, they have the same shape in three dimensions.

As shown in FIG. 6, the first, second, and third spring strands 210, 220, and 230 form a coil spring that is axially stretched and compressed. That is, the first, second, and third spring strands 210, 220, and 230 axially spirally extend.

First ends and second ends of the first, second, and third spring strands 210, 220, and 230 are coupled to the driving assembly and the supporting assembly, respectively. That is, the first, second, and third spring strands 210, 220, and 230 can connect at least one component of the driving assembly and at least one component of the supporting assembly.

For example, when the spring 200 is coupled to the stator cover 149 and the suction muffler 150, the first, second, and third spring strands 210, 220, and 230 are coupled to the stator cover 149 and the suction muffler 150.

The first, second, and third spring strands 210, 220, and 230 each have a spring height H that is an axial length. In particular, the first, second, and third spring strands 210, 220, and 230 have the same spring height H.

In detail, the axial front portions of the first, second, and third spring strands 210, 220, and 230 are positioned in the same plane. That is, the axial front portions of the first, second, and third spring strands 210, 220, and 230 are positioned in the first plane P1.

The axial rear portions of the first, second, and third spring strands 210, 220, and 230 are positioned in the same plane. That is, the axial rear portions of the first, second, and third spring strands 210, 220, and 230 are positioned in the second plane P2.

For example, the axial front portions of the first, second, and third spring strands 210, 220, and 230 can be coupled to the rear surface of the stator cover 149. For example, the axial rear portions of the first, second, and third spring strands 210, 220, and 230 can be coupled to the rear end of the suction muffler 150.

The first, second, and third spring strands 210, 220, and 230 each form a virtual circle having a spring diameter R in the radial direction. In particular, the first, second, and third spring strands 210, 220, and 230 have the same spring diameter R.

The spring central axes of the first, second, and third spring strands 210, 220, and 230 coincide. In FIG. 6 in which the first, second, and third spring strands 210, 220, and 230 are separated, central axes C1, C2, and C3 are shown. The first, second, and third spring strands 210, 220, and 230 are combined such that the spring central axes C1, C2, and C3 coincide.

The spring central axes C1, C2, and C3 of the first, second, and third spring strands 210, 220, and 230 coincide with the reciprocation central axis of the driving assembly. Accordingly, when the first, second, and third spring strands 210, 220, and 230 support the driving assembly, lateral force that is applied to the spring strands 210, 220, and 230 can be minimized.

The first, second, and third spring strands 210, 220, and 230 are circumferentially turned at different angles. The term 'circumferential' means any one of 'clockwise' and 'counterclockwise'. The first, second, and third spring strands 210, 220, and 230 are circumferentially turned at the same angle. That is, the spring strands 210, 220, and 230 are turned at 120 degrees with respect to one another.

For example, assuming that the first spring strand 210 is the center (0 degrees or 360 degrees), the second spring strand 220 is positioned circumferentially at 120 degrees from the first spring strand 210. Further, the third spring strand 230 is positioned at 240 degrees from the first spring strand 210 and at 120 degrees from the second spring strand 220.

That is, the axial front portions of the first, second, and third spring strands 210, 220, and 230 are circumferentially spaced apart from one another in the first plane P1. The axial rear portions of the first, second, and third spring strands 210, 220, and 230 are circumferentially spaced from one another in the second plane P2.

The spring 200 can be divided into a spring body 202 and both end portions of the spring body 202.

In detail, the spring body 202 axially extends while radially forming a circle having the spring diameter R. Accordingly, the spring body 202 can be formed in a spiral shape axially extending. In other words, the spring body 202 extends with a curvature that radially forms the spring diameter R.

Both end portions of the spring body 202 extend with a radially different curvature from the spring diameter R. Accordingly, both ends of the spring body 202 are positioned radially outside or inside the spring body 202.

One end is disposed in the first plane P1 and the other end is disposed in the second plane P2. Further, one end is coupled to the driving assembly and the other end is coupled to the supporting assembly.

For the convenience of description, the end disposed in the first plane P1 is referred to as a front spring link 204 and the end disposed in the second plane P2 is referred to as a rear spring link 206. Since the first plane P1 is disposed axially ahead of the second plane P2, the front spring link 204 is disposed axially ahead of the rear spring link 206.

The spring strands 210, 220, and 230 are each divided into a spring body and both end portions. The lengths of the spring bodies, the lengths of both ends, and bending angles of the spring strands 210, 220, and 230 are the same.

In detail, the first spring strand 210 is divided into a first spring body 212, a first front spring link 214, and a first rear spring link 216. The second spring strand 220 is divided into a second spring body 222, a second front spring link 224, and a second rear spring link 226. The third spring strand 230 is divided into a third spring body 232, a third front spring link 234, and a third rear spring link 236.

As for the first spring strand 210, the first spring body 212 axially extends while forming substantially one circle and semicircle. Accordingly, the first spring body 212 has two lines axially spaced apart from each other substantially at the right side (hereafter, from 0 to 180 degrees) from the central axis C in the figure.

As for the second spring strand 220, the second spring body 222 axially extends while forming substantially one circle and semicircle, similar to the first spring body 212. The second spring strand 220 is circumferentially turned at 120 degrees with respect to the first spring strand 210 and the central axis C.

Accordingly, the second spring body 222 has two lines axially spaced apart from each other substantially at 120 to 300 degrees from the central axis C in the figure.

As for the third spring strand 230, the third spring body 222 axially extends while forming substantially one circle and semicircle, similar to the first and second spring bodies 212 and 222. The third spring strand 230 is circumferentially turned at 240 degrees with respect to the first spring strand 210 and the central axis C.

Accordingly, the third spring body 232 has two lines axially spaced apart from each other substantially at 240 to 420 (60) degrees from the central axis C in the figure.

When the spring strands 210, 220, and 230 are combined around the central axis C into one spring 200, the first, second, and third spring bodies 212, 222, and 232 are axially sequentially spaced apart from one another.

Referring to the left side in FIG. 5, the second spring body 222, the third spring body 232, the firs spring body 212, the second spring body 222, and the third spring body 232 are sequentially arranged downward from the top.

In particular, the spring bodies 212, 222, and 232 are spaced with the same intervals apart from axially adjacent spring bodies 212, 222, and 232. In detail, the third spring body 232 and the first spring body 212 are disposed inside the portions disposed axially in the same line of the second spring body 222.

The first, second, and third spring bodies 212, 222, and 232 extend with the same spring diameter R. Accordingly, the entire shape of the spring body 202 can be a cylindrical shape. In detail, a cylindrical shape axially extending the spring height H and having the spring diameter R radially from the spring central axis C is formed.

The first, second, and third front spring links 214, 224, and 234 are circumferentially spaced apart from one another at 120 degrees in the first plane P1. The first, second, and third rear spring links 216, 226, and 236 are circumferentially spaced apart from one another at 120 degrees in the second plane P2.

The first, second, and third front spring links 214, 224, and 234 are bent radially outward and the first, second, and third rear spring links 216, 226, and 236 are bent radially inward. In other words, the first, second, and third front spring links 214, 224, and 234 are disposed radially outside the spring body 202. Further, the first, second, and third rear spring links 216, 226, and 236 are disposed radially inside the spring body 202.

The bending angles or lengths of the first, second, and third front spring links 214, 224, and 234 and the first, second, and third rear spring links 216, 226, and 236 may be different, depending on design. In particular, the bending angles or lengths may be different, depending on the coupling structures of the first, second, and third front spring links 214, 224, and 234 and the first, second, and third rear spring links 216, 226, and 236.

As described above, a spring of the present invention can be composed of a plurality of spring strands. The spring can be modified in various shapes. Exemplary shapes of the spring are described hereafter. The above description is referred to for the same configuration and the same components are indicated by different reference numerals for the convenience of understanding.

Figure 7:
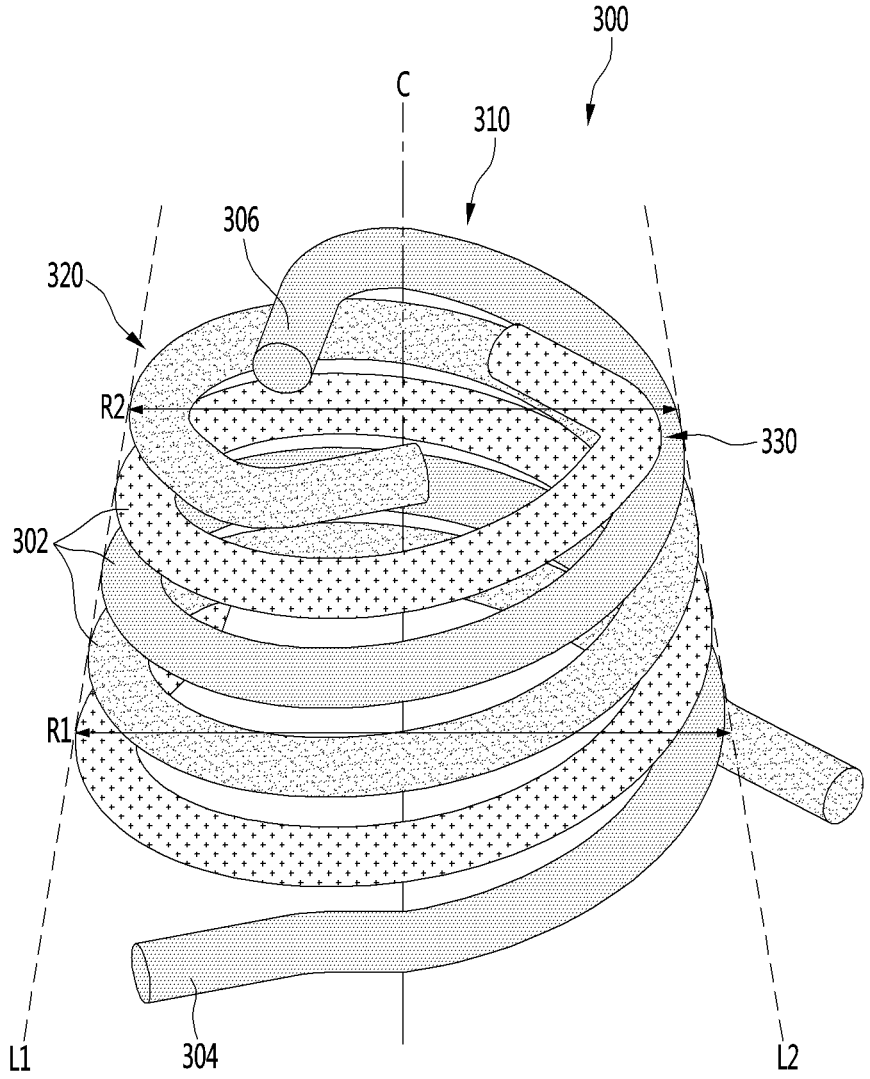
FIGS. 7 and 8 are views discriminately showing springs of a linear compressor according to a second embodiment of the present invention.
Figure 8:
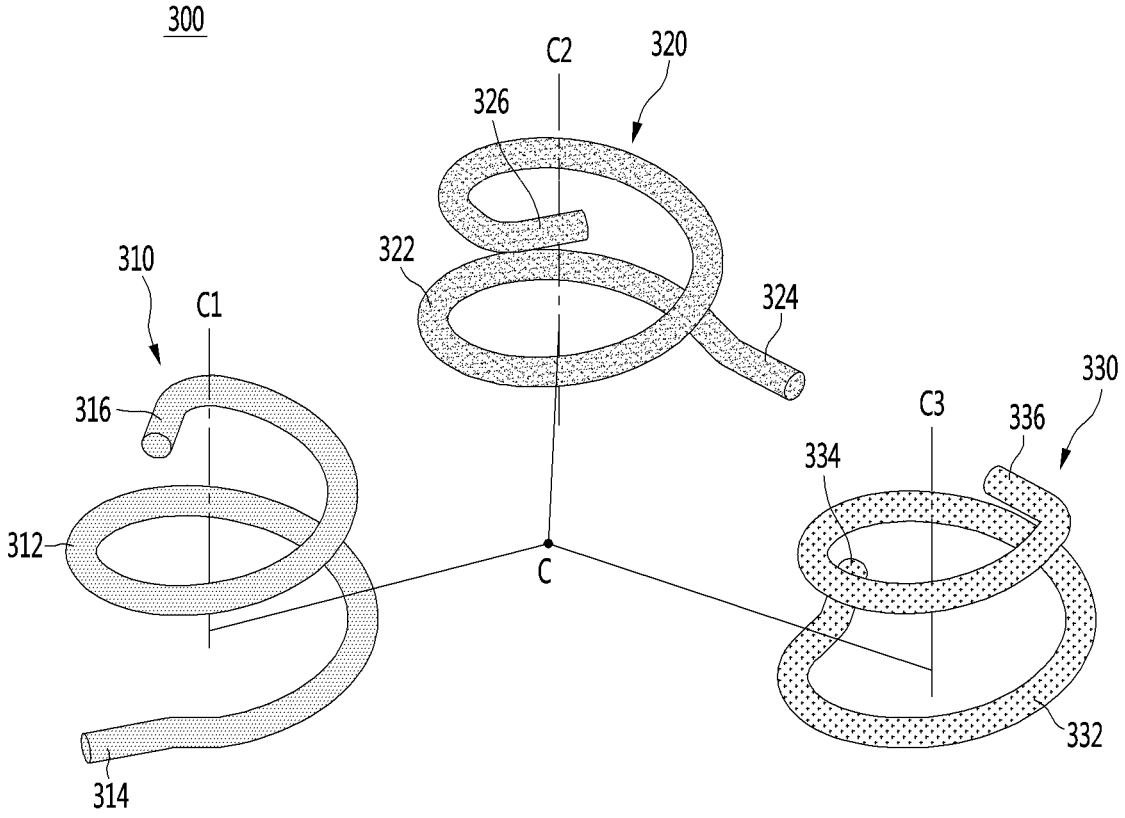

FIGS. 7 and 8 are views discriminately showing springs of a linear compressor according to a second embodiment of the present invention.

As shown in FIGS. 7 and 8, a spring 300 composed of a plurality of spring strands 310, 320, and 330 is provided. The spring 300 is divided into a spring body 302 spirally extending and both end portions (hereafter, a front spring link 302 and a rear spring link 304) of the spring body 306.

The spring strands have the same shape and are circumferentially spaced apart from one another with the same intervals. The spring strands include a first spring strand 310, a second spring strand 320, and a third spring strand 330.

The first, second, and third spring strands 310, 320, and 330 are circumferentially differently turned. The term 'circumferential' means any one of 'clockwise' and 'counterclockwise'. The first, second, and third spring strands 310, 320, and 330 are circumferentially turned at the same angle. That is, the spring strands 310, 320, and 330 are turned at 120 degrees with respect to one another.

The spring strands 310, 320, and 330 are each divided into a spring body and both end portions. In detail, the first spring strand 310 is divided into a first spring body 312, a first front spring link 314, and a first rear spring link 316. The second spring strand 320 is divided into a second spring body 322, a second front spring link 324, and a second rear spring link 326. The third spring strand 330 is divided into a third spring body 332, a third front spring link 334, and a third rear spring link 336.

The spring 300 has a spring height H that is an axial length and the first, second, and third spring strands 310, 320, and 330 have the same spring height H. Accordingly, the first, second, and third front spring links 314, 324, and 334 are disposed in a first plane P1 that is a plane perpendicular to the axial direction and the first, second, third rear spring links 316, 326, and 336 are disposed in a second plane P2 that is a plane perpendicular to the axial direction.

The first, second, and third front spring links 314, 324, and 334 are circumferentially spaced apart from one another at 120 degrees in the first plane P1. The first, second, and third rear spring links 316, 326, and 336 are circumferentially spaced apart from one another at 120 degrees in the second plane P2.

The first, second, and third front spring links 314, 324, and 334 are bent radially outward and the first, second, and third rear spring links 316, 326, and 336 are bent radially inward. The bending angles or lengths of the first, second, and third front spring links 314, 324, and 334 and the first, second, and third rear spring links 316, 326, and 336 may be different, depending on design.

The first, second, and third spring bodies 310, 320, and 330 extend while each forming a virtual circle having a spring diameter R in the radial direction. The center of the spring diameter R is referred to as a spring center and a line axially extending from the spring center is referred to as a spring central axis C. The spring central axis C coincides with a reciprocation central axis of the driving assembly including the piston 130.

The spring central axes of the first, second, and third spring strands 310, 320, and 330 coincide. In FIG. 8 in which the first, second, and third spring strands 310, 320, and 330 are separated, central axes C1, C2, and C3 are shown.

The first, second, and third spring bodies 312, 322, and 332 are axially sequentially arranged with predetermined intervals. Referring to the left side in FIG. 7, the second spring body 322, the third spring body 332, the firs spring body 312, the second spring body 322, and the third spring body 332 are sequentially arranged downward from the top.

The first, second, and third spring bodies 310, 320, and 330 extend such that the spring diameter R is radially changed. In particular, the spring diameter R may be axially linearly changed.

The spring diameter R may be defined as a line extending the radial outer side of the spring 300. In the figure, the left line is referred to as a first extension line L1 and the right line is referred to as a second extension line L2. The first extension line L1 and the second extension line L2 can be understood as being circumferentially spaced apart from each other by the maximum distance (180 degrees).

The first extension line L1 and the second extension line L2 may extend at an angle to a side from the axial direction. In FIG. 7, the first extension line L1 and the second extension line L2 extend to come closer to the central axis C as they go upward.

However, this is just an example and the spring of the present invention may be formed such that the first extension line L1 and the second extension line L2 are inclined in various shapes. For example, the first extension line L1 and the second extension line L2 extend to go away from the central axis C as they go upward.

The spring diameter R corresponds to the radial distance between the first extension line L1 and the second extension line L2. Referring to FIG. 7, the spring body 302 close to the front spring link 304 forms a virtual circle having a first spring diameter R1 and the spring body 302 close to the rear spring link 306 forms a virtual circle having a second spring diameter R2.

The second spring diameter R2 is smaller than the first spring diameter R1. That is, the spring body 302 extends such that the spring diameter decreases from the axial front portion to rear portion.

As for the first spring body 312, it axially extends while forming substantially one circle and semicircle. In particular, the first spring body 312 may axially extend such that the diameter (or the radius of curvature) gradually decreases as it goes axially rearward. In other words, the first spring body 312 may axially extend such that the curvature gradually increases as it goes axially rearward.

Accordingly, the first spring body 312 has two lines axially spaced apart from each other substantially at the right side (hereafter, from 0 to 180 degrees) from the central axis C in the figure. The axially spaced portions are not positioned axially in the same line. In detail, the portion close to the axial rear portion is disposed closer to the central axis C than the portion close to the axial front portion.

The second spring body 322 and the third spring body 332 also axially extend while forming substantially one circle and semicircle, similar to the first spring body 312. In particular, the second and third spring bodies 322 and 332 may axially extend such that the diameter (or the radius of curvature) gradually decreases as it goes axially rearward.

The second spring strand 320 is circumferentially turned at 120 degrees with respect to the first spring strand 310 and the central axis C. Accordingly, the second spring body 322 has two lines axially spaced apart from each other substantially at 120 to 300 degrees from the central axis C in the figure.

The third spring strand 330 is circumferentially turned at 240 degrees with respect to the first spring strand 310 and the central axis C. Accordingly, the third spring body 332 has two lines axially spaced apart from each other substantially at 240 to 420 (60) degrees from the central axis C in the figure.

The axially spaced portions of the second spring body 322 and the third spring body 332 are not positioned axially in the same line. In detail, the portion close to the axial rear portion is disposed closer to the central axis C than the portion close to the axial front portion.

Accordingly, the entire shape of the spring body 302 can be a circular conical shape. In detail, it is a frustoconical shape. Accordingly, an end of the spring body 302 has the first spring diameter R1 in the radial direction and the other end of the spring body 302 has the second spring diameter R2 in the radial direction with respect to the spring central axis C. Further, the spring body 302 axially extends by a spring height H.

The first spring diameter R1 and the second spring diameter R2 are coaxially defined. That is, the centers of the first spring diameter R1 and the second spring diameter R2 are the same and a line axially extending from the centers is the spring central axis C.

As described above, the spring of the present invention can be formed such that spring diameters R are axially different.

Figure 9:
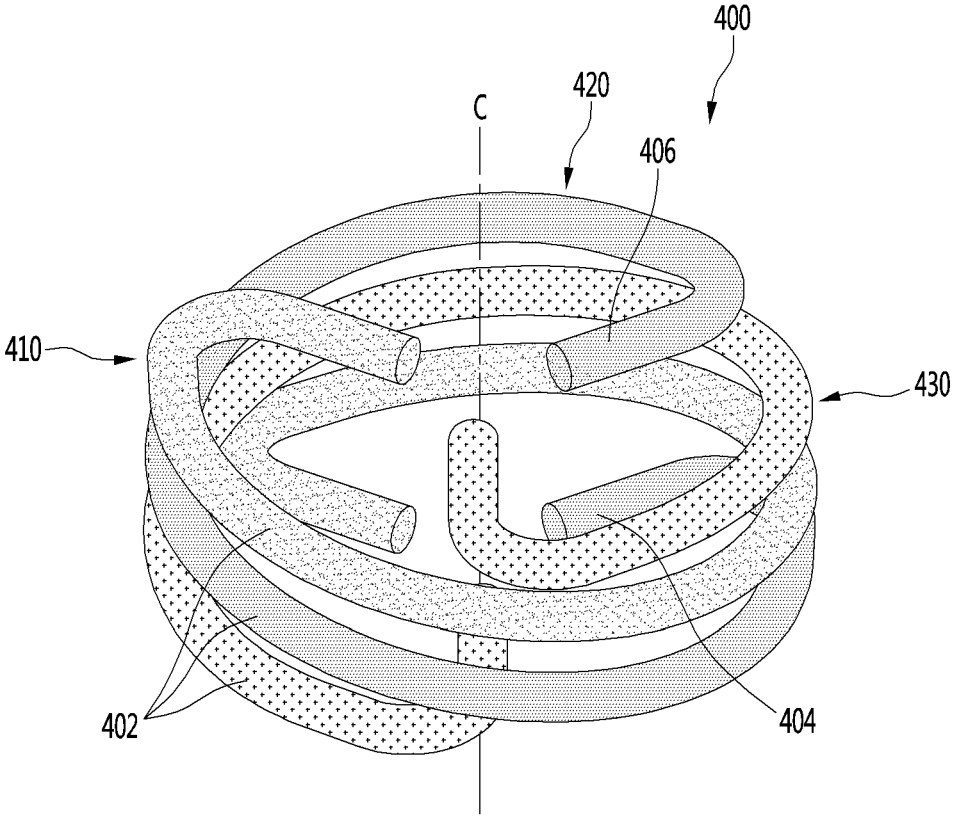
FIGS. 9 and 10 are views discriminately showing springs of a linear compressor according to a third embodiment of the present invention.
Figure 10:
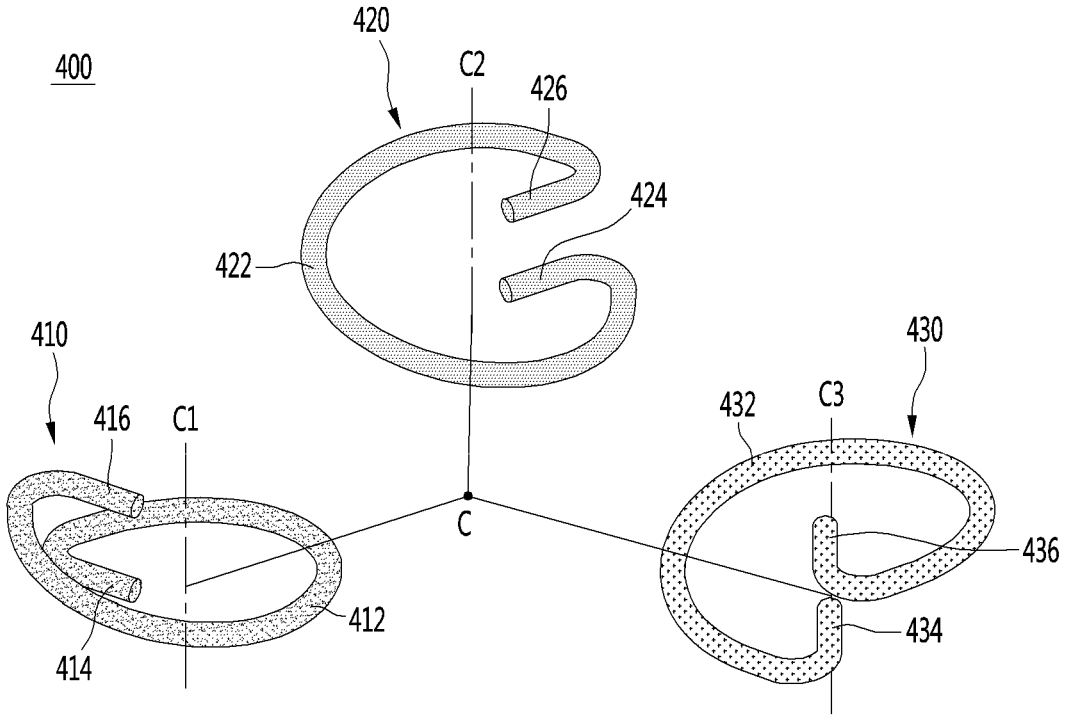

FIGS. 9 and 10 are views discriminately showing springs of a linear compressor according to a third embodiment of the present invention.

As shown in FIGS. 9 and 10, a spring 400 composed of a plurality of spring strands 410, 420, and 430 is provided. The spring 400 is divided into a spring body 402 spirally extending and both end portions (hereafter, a front spring link 404 and a rear spring link 406) of the spring body 402.

The spring strands have the same shape and are circumferentially spaced apart from one another with the same intervals. The spring strands include a first spring strand 410, a second spring strand 420, and a third spring strand 430. The spring strands 410, 420, and 430 are each divided into a spring body and both end portions.

In detail, the first spring strand 410 is divided into a first spring body 412, a first front spring link 414, and a first rear spring link 416. The second spring strand 420 is divided into a second spring body 422, a second front spring link 424, and a second rear spring link 426. The third spring strand 430 is divided into a third spring body 432, a third front spring link 434, and a third rear spring link 436.

The spring 400 has a spring height H that is an axial length and the first, second, and third spring strands 410, 420, and 430 have the same spring height H. Accordingly, the first, second, and third front spring links 414, 424, and 434 are disposed in a first plane P1 that is a plane perpendicular to the axial direction and the first, second, third rear spring links 416, 426, and 436 are disposed in a second plane P2 that is a plane perpendicular to the axial direction.

The first, second, and third spring bodies 410, 420, and 430 extend while each forming a virtual circle having a spring diameter R in the radial direction. The center of the spring diameter R is referred to as a spring center and a line axially extending from the spring center is referred to as a spring central axis C. The spring central axis C coincides with a reciprocation central axis of the driving assembly including the piston 130.

The spring central axes of the first, second, and third spring strands 410, 420, and 430 coincide. In FIG. 10 in which the first, second, and third spring strands 410, 420, and 430 are separated, central axes C1, C2, and C3 are shown.

The first, second, and third spring bodies 410, 420, and 430 axially extend with the same spring diameter R. Accordingly, the entire shape of the spring body 402 can be a cylindrical shape. In detail, a cylindrical shape axially extending the spring height H and having the spring diameter R radially from the spring central axis C is formed.

As for the first spring body 412, it axially extends while forming substantially one circle. The second and third spring bodies 422 and 432 also axially extend while forming one circle, similar to the first spring body 412. Compared with the spring bodies 202 and 302 described above, it can be understood that when the spring diameters R are the same, the spring height H of the spring 400 is small.

The first, second, and third front spring links 414, 424, and 434 are circumferentially spaced apart from one another at 120 degrees in the first plane P1. The first, second, and third rear spring links 416, 426, and 436 are circumferentially spaced apart from one another at 120 degrees in the second plane P2.

The first, second, and third front spring links 414, 424, and 434 and the first, second, and third rear spring links 416, 426, and 436 are bent radially inward. That is, the first, second, and third front spring links 414, 424, and 434 and the first, second, and third rear spring links 416, 426, and 436 are all positioned radially inside the spring body 402.

Larger load may be applied to the ends bent outward than the ends bent inward. In particular, load may be concentrated on the ends bent outward at the bending portions. Accordingly, the spring 400 of which both ends are bent inward can resist larger load than the springs 200 and 300 described above.

Accordingly, the spring 400 may have a spring height H smaller than those of the springs 200 and 300 described above. The spring height means a length when external force is not applied. That is, the spring height H may depend on the design conditions of the compressor 10 or the shape of the spring.

The bending angles or lengths of the first, second, and third front spring links 414, 424, and 434 and the first, second, and third rear spring links 416, 426, and 436 may be different, depending on design. As described above, the spring of the present invention may be formed such that both ends are bent radially inward.

Figure 11:
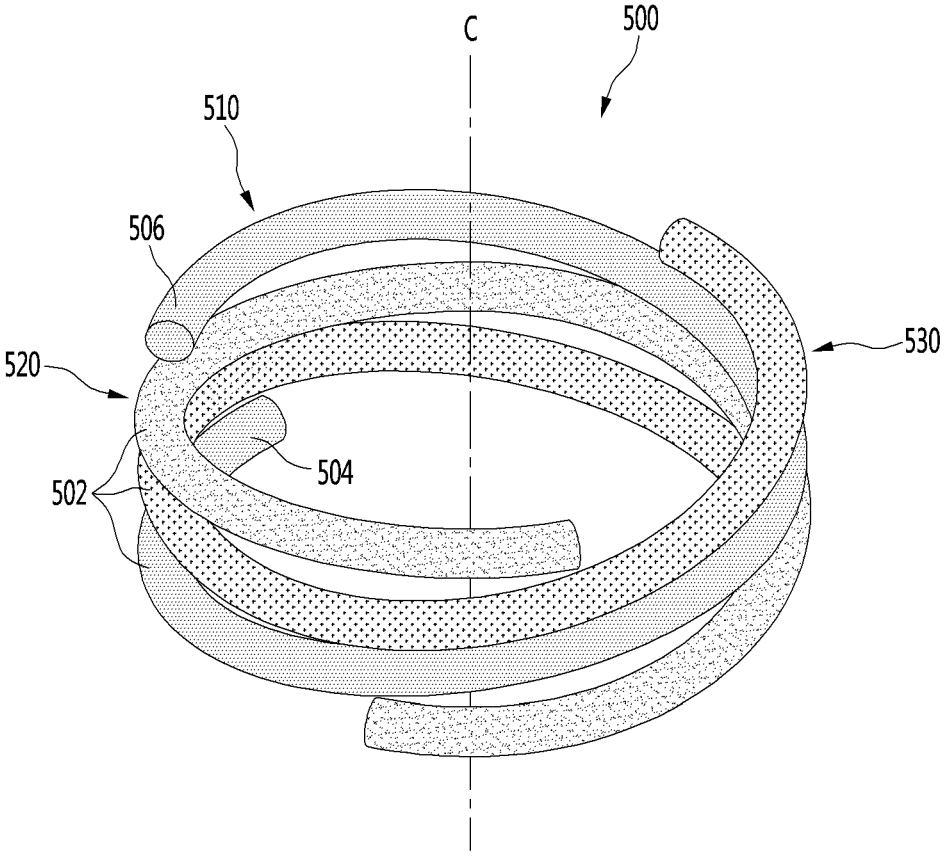
FIGS. 11 and 12 are views discriminately showing springs of a linear compressor according to a fourth embodiment of the present invention.
Figure 12:
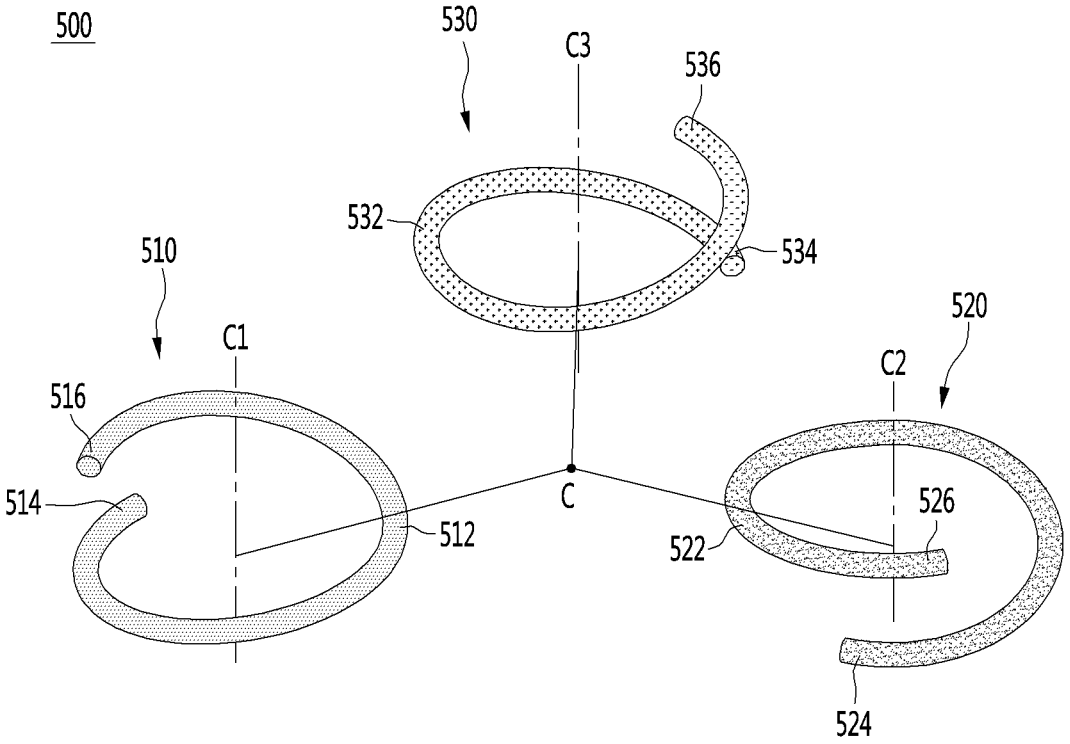

FIGS. 11 and 12 are views discriminately showing springs of a linear compressor according to a fourth embodiment of the present invention.

As shown in FIGS. 11 and 12, a spring 500 composed of a plurality of spring strands 510, 520, and 530 is provided. The spring 500 is divided into a spring body 502 spirally extending and both end portions (hereafter, a front spring link 504 and a rear spring link 506) of the spring body 502.

The spring strands have the same shape and are circumferentially spaced apart from one another with the same intervals. The spring strands include a first spring strand 510, a second spring strand 520, and a third spring strand 530.

The first, second, and third spring strands 510, 520, and 530 are circumferentially differently turned. The term 'circumferential' means any one of 'clockwise' and 'counterclockwise'. The first, second, and third spring strands 510, 520, and 530 are circumferentially turned at the same angle. That is, the spring strands 510, 520, and 530 are turned at 120 degrees with respect to one another.

The spring strands 510, 520, and 530 are each divided into a spring body and both end portions (a front spring link and a rear spring link). In detail, the first spring strand 510 is divided into a first spring body 512, a first front spring link 514, and a first rear spring link 516. The second spring strand 520 is divided into a second spring body 522, a second front spring link 524, and a second rear spring link 526. The third spring strand 530 is divided into a third spring body 532, a third front spring link 534, and a third rear spring link 536.

The spring 500 has a spring height H that is an axial length and the first, second, and third spring strands 510, 520, and 530 have the same spring height H. Accordingly, the first, second, and third front spring links 514, 524, and 534 are disposed in a first plane P1 that is a plane perpendicular to the axial direction and the first, second, third rear spring links 516, 526, and 536 are disposed in a second plane P2 that is a plane perpendicular to the axial direction.

The first, second, and third spring bodies 510, 520, and 530 extend while each forming a virtual circle having a spring diameter R in the radial direction. The center of the spring diameter R is referred to as a spring center and a line axially extending from the spring center is referred to as a spring central axis C. The spring central axis C coincides with a reciprocation central axis of the driving assembly including the piston 130.

The spring central axes of the first, second, and third spring strands 510, 520, and 530 coincide. In FIG. 12 in which the first, second, and third spring strands 510, 520, and 530 are separated, central axes C1, C2, and C3 are shown.

The first, second, and third spring bodies 512, 522, and 532 are axially sequentially arranged with predetermined intervals. Referring to the left side in FIG. 11, the second spring body 522, the third spring body 532, and the first spring body 512 are sequentially arranged downward from the top.

The first, second, and third spring bodies 510, 520, and 530 axially extend with the same spring diameter R. Accordingly, the entire shape of the spring body 502 can be a cylindrical shape. In detail, a cylindrical shape axially extending the spring height H and having the spring diameter R radially from the spring central axis C is formed.

The first, second, and third front spring links 514, 524, and 534 and the first, second, and third rear spring links 516, 526, and 536 extend with the same curvature as that of the spring body 502. In other words, a bending end is not formed at the spring 500. Accordingly, the front spring link 504 and the rear spring link 506 can be understood as a portion of the spring body 502.

Larger load may be applied to the end circumferentially extending than the ends bent outward. This is because, as described above, load may be concentrated on the ends bent outward at the bending portions. Accordingly, the spring 500 of which both ends circumferentially extend can resist larger load than the springs 200 and 300 described above.

The spring 500 may have a spring height H smaller than those of the springs 200 and 300 described above. The spring height means a length when external force is not applied. That is, the spring height H may depend on the design conditions of the compressor 10 or the shape of the spring.

In particular, since it is not required to form bending ends at the spring 500, machinability can be improved. As described above, the spring of the present invention can be formed in a common coil spring shape.

As described above, the spring of the present invention can be formed in various shapes. The shapes shown in the figures are example and the spring of the present invention can be modified in various ways.

What is claimed is:

1. A linear compressor comprising:

a piston configured to reciprocate along an axial direction of the piston; and a spring configured to support the piston in the axial direction and arranged about a spring central axis that extends in the axial direction, wherein the spring comprises a plurality of spring strands, each spring strand comprising:

a spring body that extends in the axial direction, that defines a spiral shape around the spring central axis, and that defines a reference circle having a spring diameter, a front spring link that extends from a first end of the spring body, and a rear spring link that extends from a second end of the spring body, the second end being spaced apart from the first end in the axial direction, wherein the rear spring link is curved from the spring body and extends radially inward of the spring body, and wherein the front spring link is disposed forward relative to the spring body along the spring central axis, and the rear spring link is disposed rearward relative to the spring body along the spring central axis.

2. The linear compressor of claim 1, wherein the plurality of spring strands are circumferentially arranged about the spring central axis and spaced apart from one another by an equal angle about the spring central axis.

3. The linear compressor of claim 2, wherein the plurality of spring strands comprise a first spring strand, a second spring strand, and a third spring strand, and wherein the first spring strand, the second spring strand, and the third spring strand are circumferentially arranged about the spring central axis and spaced apart from one another by 120 degrees about the spring central axis.

4. The linear compressor of claim 3, wherein the front spring links of the first spring strand, the second spring strand, and the third spring strand are arranged in a first plane orthogonal to the spring central axis and circumferentially spaced apart from one other by 120 degrees about the spring central axis, and wherein the rear spring links of the first spring strand, the second spring strand, and the third spring strand are arranged in a second plane orthogonal to the spring central axis and circumferentially spaced apart from one another by 120 degrees about the spring central axis.

5. The linear compressor of claim 4, wherein the first plane and the second plane is spaced apart from each other in the axial direction.

6. The linear compressor of claim 4, wherein the spring bodies of the first spring strand, the second spring strand, and the third spring strand define an outer circumference of the spring and are arranged along the axial direction.

7. The linear compressor of claim 6, wherein the spring body of the second spring strand is disposed axially between the spring body of the first spring strand and the spring body of the third spring strand.

8. The linear compressor of claim 1, wherein the front spring link is curved from the spring body and extends radially outward of the spring body.

9. The linear compressor of claim 1, wherein the spring diameter varies as the spring body extends in the axial direction.

10. The linear compressor of claim 9, wherein the spring diameter decreases as the spring body extends in the axial direction, wherein the spring body defines a first reference circle at a position corresponding to the front spring link, the first reference circle having a first spring diameter about the spring central axis, and wherein the spring body defines a second reference circle at a position corresponding to the rear spring link, the second reference circle having a second spring diameter less than the first spring diameter.

11. The linear compressor of claim 1, wherein the plurality of spring strands have a same shape and size.

12. The linear compressor of claim 1, wherein the plurality of spring strands are spaced apart from one another in the axial direction.

13. The linear compressor of claim 1, wherein the front spring link and the rear spring link are disposed opposite sides of the spring body along the spring central axis.

14. The linear compressor of claim 1, wherein rear ends of the rear spring links of the plurality of spring strands extend toward one another, and wherein front ends of the front spring links of the plurality of spring strands extend away from one another.

15. A linear compressor comprising:

a cylinder defines a compression space configured to receive refrigerant;

a piston located in the cylinder and configured to reciprocate relative to the cylinder along an axial direction, the piston being configured to compress refrigerant received in the cylinder; and a spring that is disposed at an end of the cylinder, that extends in the axial direction, and that is configured to support the piston in the axial direction, the spring comprising a plurality of spring strands that define a circumference of the spring, wherein each of the plurality of spring strands has a first end that is disposed outside of the circumference of the spring, a second end that is spaced apart from the first end in the axial direction and that is disposed inside of the circumference of the spring, and a spring body disposed between the first end and the second end, wherein the first ends of the plurality of spring strands are disposed forward relative to the spring bodies of the plurality of spring strands along the axial direction, and wherein the second ends of the plurality of spring strands are disposed rearward relative to the spring bodies of the plurality of spring strands along the axial direction.

16. The linear compressor of claim 15, wherein each first end of the plurality of spring strands is curved in a direction radially outward from the circumference of the spring, and wherein each second end of the plurality of spring strands is curved in a direction radially inward from the circumference of the spring.

17. The linear compressor of claim 15, wherein a diameter of the circumference of the spring decreases as the spring extends from the first end to the second end in the axial direction.

* * * * *